US008177227B2

(12) United States Patent
Uchiyama et al.

(10) Patent No.: US 8,177,227 B2
(45) Date of Patent: May 15, 2012

(54) SHEET EJECTION DEVICE, IMAGE FORMING APPARATUS AND POST-PROCESSING APPARATUS

(75) Inventors: Masaaki Uchiyama, Hachioji (JP); Hiroyuki Wakabayashi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 184 days.

(21) Appl. No.: 12/470,701

(22) Filed: May 22, 2009

(65) Prior Publication Data

US 2009/0295074 A1 Dec. 3, 2009

(30) Foreign Application Priority Data

May 27, 2008 (JP) ..... 2008-137731

(51) Int. Cl.
*B65H 31/26* (2006.01)

(52) U.S. Cl. ..... 271/220; 271/226

(58) Field of Classification Search ..... 271/220, 271/226, 227
See application file for complete search history.

(56) References Cited

U.S. PATENT DOCUMENTS 5,963,754 A * 10/1999 Itoh et al. ..... 399/21
6,279,899 B1 * 8/2001 Coffey et al. ..... 271/220
7,451,980 B2 * 11/2008 Tamura et al. ..... 271/220
7,677,557 B2 * 3/2010 Ino ..... 271/220
7,766,324 B2 * 8/2010 Tamura et al. ..... 271/213
2002/0158405 A1 * 10/2002 Nagasako et al. ..... 271/213
2003/0193132 A1 * 10/2003 Robertson et al. ..... 271/220
2007/0108697 A1 * 5/2007 Tamura et al. ..... 271/220
2007/0145675 A1 * 6/2007 Tamura et al. ..... 271/207
2007/0176357 A1 * 8/2007 Horio et al. ..... 271/220
2008/0054550 A1 * 3/2008 Hama ..... 271/220
2009/0289412 A1 * 11/2009 Tanaka et al. ..... 271/220

FOREIGN PATENT DOCUMENTS

JP 2001-341927 A 12/2001
JP 2006-206331 A 8/2006
JP 2009102154 A * 5/2009

OTHER PUBLICATIONS

Japanese Office Action dated May 18, 2010 and English translation thereof, issued in counterpart Japanese Application No. 2008-137731.

* cited by examiner

*Primary Examiner* — Michael McCullough
*Assistant Examiner* — Howard Sanders
(74) *Attorney, Agent, or Firm* — Holtz, Holtz, Goodman & Chick, PC

(57) ABSTRACT

A sheet ejection device capable of applying shift processing to the sheets on an ejection tray, using the alignment member contacting the sheets at a plurality of points in the direction in which the sheets are ejected.

19 Claims, 8 Drawing Sheets

SHEET EJECTION DEVICE, IMAGE FORMING APPARATUS AND POST-PROCESSING APPARATUS

This application is based on Japanese Patent Application No. 2008-137731 filed on May 27, 2008 in Japanese Patent Office, the entire content of which is hereby incorporated by reference.

BACKGROUND OF THE INVENTION

The present invention relates to a sheet ejection device having a shift processing function, an image forming apparatus equipped with such a sheet ejection device, and a post-processing apparatus provided with such a sheet ejection device.

The sheet processing apparatus for processing a great number of sheets is often provided with a sheet ejection device having a function of shifting the position for each number of sheets having been set and loading the sheets on the ejection tray.

The sheet ejection device equipped with the shift function is required to ensure that each of the sheet bundles sorted out by shift processing is aligned to a high precision. For this purpose, development efforts have been made to implement a shift processing mechanism capable of providing a highly advanced aligning function.

The image forming system capable of high-speed processing which includes an image forming apparatus tends to be utilized as a quick printing apparatus. When this image forming system is used as a quick printing apparatus, the image forming system is increasingly required to ensure that the sheets having been subjected to the processing of image formation or the like are ejected while being aligned with high precision.

There has been an increasing demand for the sheet shift ejection as the sheet ejection mode.

For example, the Japanese Unexamined Patent Application Publication No. 2006-206331 proposes a method of installing a shifting mechanism on the ejection tray, whereby sheets are shifted in a highly aligned form and are stacked in position.

Referring to FIG. 1, the following describes the overview of the shifting mechanism disclosed in the Japanese Unexamined Patent Application Publication No. 2006-206331, FIG. 1 shows that sheets are aligned by a pair of aligning members 102*a* and 102*b*, and shift processing is carried out.

The aligning members 102*a* and 102*b* travel above the sheets stacked on an ejection tray, and determine the position in the direction at right angles to the sheet ejection direction.

The bottom edges of the aligning members 102*a* and 102*b* are formed in a gently curved configuration so as to ensure contact with sheets, as illustrated in FIG. 14 of the Japanese Unexamined Patent Application Publication No. 2006-206331, for example.

This configuration allows a pair of aligning members 102*a* and 102*b* to accomplish the function of setting the sheet position and the function of aligning the sheets at the set position alternately.

The shifting mechanism disclosed in the Japanese Unexamined Patent Application Publication No. 2006-206331, however, entails a problem of insufficient aligning precision, as will be described below.

The aforementioned problem will be discussed with reference to FIGS. 1 and 2.

The topmost surface of the sheet on the ejection tray is maintained at a predetermined height indicated by point P0 under the control wherein the ejection tray travels in the vertical direction using the top surface sensor for detecting the topmost surface of the sheet.

At the position wherein the alignment member SB comes in contact with the sheets, however, the height and angle of the topmost surface of the sheet are changed by the curling of sheets.

In FIG. 1, Sn indicates the topmost surface of the uncurled sheet, while Sm shows the topmost surface of the curled sheet.

As a result of changes on the sheet topmost surface as shown in FIG. 1, the alignment member changes from SBn to SBm due to curling of the sheet. This change causes the contact point between the sheet and alignment member to be changed from P1 to P2. As is apparent from the drawing, the contact point between the sheet and alignment member shifts not only in height but also in the sheet ejection direction W.

As shown in FIG. 2, based on the assumption that the sheets are placed correctly on the ejection tray, the center point of action of the alignment member is set at point P1, wherein this alignment member aligns the sheet by reciprocating motion across the sheet width at right angles to the sheet ejection direction W. The contact point of the alignment member SBn for regulating the position of the sheet Sn that does not curl is P1, and agrees with the center point of action P1 of the alignment member that performs reciprocating motion. However, the contact point P2 of the alignment member SBm for regulating the position of the curled sheet is misaligned with the center point of action P1.

Accordingly, when sheets are uncurled and are stacked correctly on the ejection tray, the contact point of the alignment member for regulating the position and the center point of action of the other alignment member for carrying out alignment operation correspond to the same point P1 in the sheet ejection direction W, and sheets are aligned to the state indicated by Sn.

However, if sheets are curled, the contact point of the position regulating alignment member shifts from P1 to P2, as shown in FIG. 1.

As a result, the contact point P2 of the alignment member for regulating the position of the sheet is misaligned with the center point of action P1 of the other alignment member for carrying out alignment operation, in the sheet ejection direction W, as shown in FIG. 2.

Because of this misalignment, the force of the alignment member for carrying out alignment operation acts as the moment for rotating the sheet, so that sheets are inclined, as indicated by Sm of FIG. 2.

Specifically, correct alignment of sheets is not achieved.

SUMMARY

An aspect of the present invention is as follows.

1. A sheet ejection device including:

an ejection tray on which a sheet having been ejected is stacked;

a pair of alignment members for aligning the end positions of the sheet in the direction perpendicular to the ejection direction of the sheet ejected on the ejection tray; and a drive device for setting one of the alignment members at a position so as to come in contact with the top surface of the sheet stacked on the ejection tray and for driving the other alignment member so as to press the edge of the sheet which has been further ejected onto the sheet whose top surface is kept in contact with the one of alignment member, wherein the one of alignment members comes in contact with the top surface of the sheet stacked on the ejection tray at a plurality of points in the sheet ejection direction.

2. An image forming apparatus provided with the sheet ejection device described in Item 1.

3. A post-processing apparatus provided with the sheet ejection device described in Item 1.

DETAILED DESCRIPTION OF THE PREFERRED EMBODIMENTS

Figure 3:
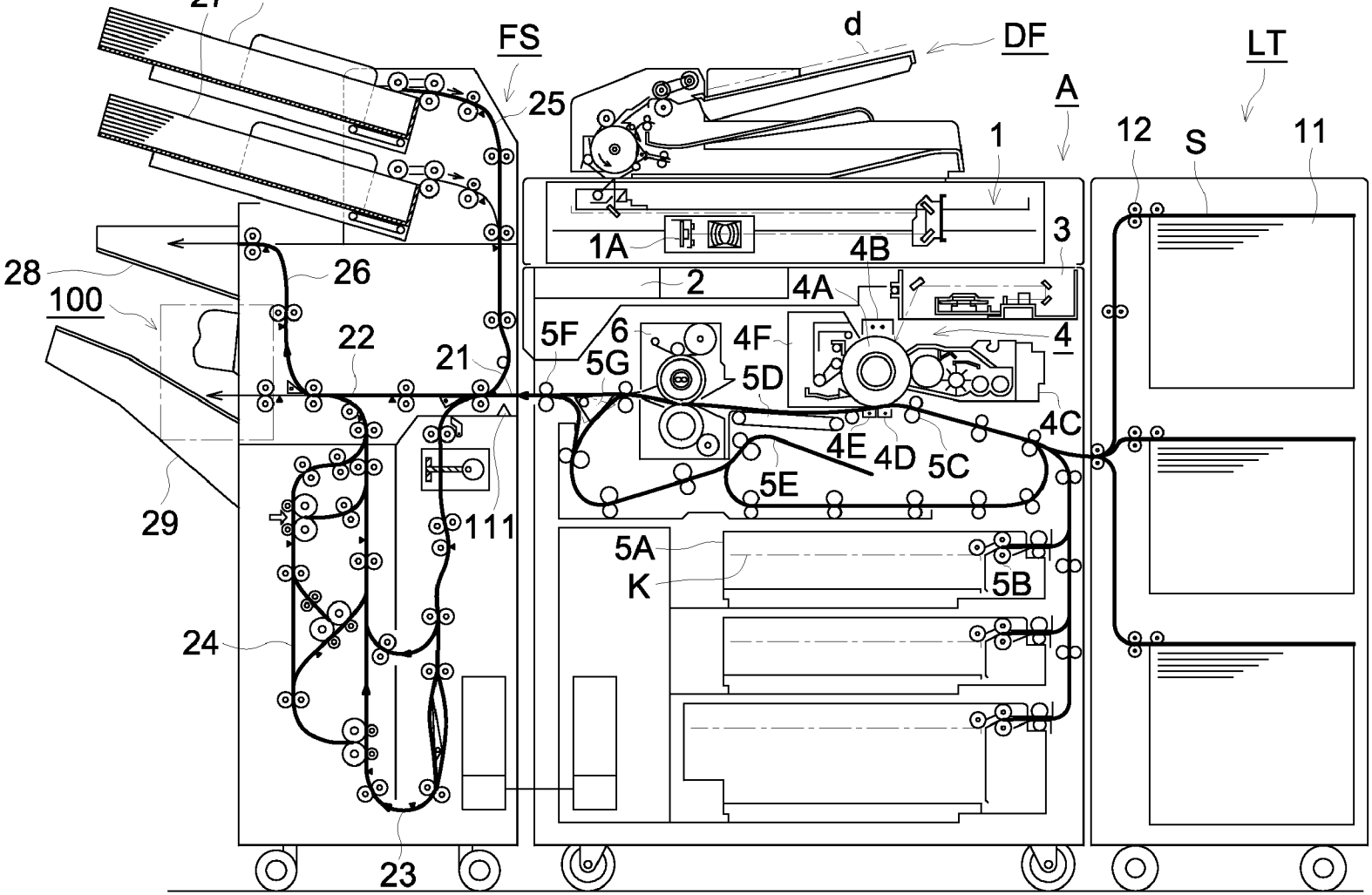
FIG. 3 is a diagram showing the overall configuration of the image forming system equipped with the sheet ejection device relating to an embodiment of the present invention.

FIG. 3 is a diagram showing the overall configuration of the image forming system equipped with an image forming apparatus A, automatic document feeder DF, post-processing apparatus FS, and large capacity sheet feeding unit LT.

The image forming apparatus A illustrate in FIG. 3 includes an image reading section 1, image processing section 2, image writing section 3, image formation section 4, sheet conveyance section and fixing device 6.

The image formation section 4 contains a photosensitive drum 4A, charging device 4B, development device 4C, transfer device 4D, separation device 4E, cleaning device 4F and others.

The sheet conveyance section includes a sheet feed cassette 5A, first sheet feed section 5B, second sheet feed section 5C, first conveyance section 5D, second conveyance section (automatic duplex copy conveyance section) 5E and sheet ejection section 5F.

A post-processing apparatus FS is connected on the side of the sheet ejection section 5F on the left face of the image forming apparatus A in the diagram.

The image on one side or both sides of the document "d" placed on the document platen of the automatic document feeder DF is read by the optical system of the image reading section 1 and is captured by the CCD image sensor 1A.

The analog signal having been subjected to photoelectric conversion by the CCD image sensor 1A is further subjected to processing such as analog processing, analog-to-digital conversion, shading correction, image compression processing by the image processing section 2, and is stored in the image memory (not illustrated).

In the image writing section 3, the photosensitive drum 4A of the image formation section 4 is radiated with the light emitted from a semiconducting laser, whereby a latent image is formed. Such processing operations as charging, exposure, development, transfer, separation and cleaning are carried out in the image formation section 4. The transfer device 41 allows the image to be transferred onto the sheets S having been fed from the sheet feed cassette BA by the first sheet feed section 5B or having been fed from large capacity sheet feeding unit LT. The sheets S carrying the image undergo the processing of fixing by the fixing device 6, and are conveyed to the post-processing apparatus FS from the sheet ejection section 5F.

The sheets S subjected to the processing of fixing are conveyed to the second conveyance section 5E by a conveyance path switching board 5G, and are further conveyed. An image is formed on the rear faces of the sheets S in the image formation section 4. These sheets S are then rejected from the sheet ejection section 5F.

The large capacity sheet feeding unit LT includes a sheet stacking device 11 and first sheet feed device 12, and are loaded with a great number of sheets S to be conveyed into the image forming apparatus A.

The post-processing apparatus FS applies processing of folding and shifting to the sheets S and additional sheets F, and ejects them to the fixed ejection tray 28 or elevating ejection tray 29.

The post-processing apparatus FS includes a sheet loading section 21, horizontal conveyance section 22, downward conveyance section 23, folding processing section 24, additional sheets conveyance section 25 and upward conveyance section 26.

The sheets S ejected from the image forming apparatus A pass through the horizontal conveyance section 22 and is ejected to the fixed ejection tray 28 through the upward conveyance section 26. Alternatively the sheets S ejected from the image forming apparatus A pass through the horizontal conveyance section 22, and are ejected to the elevating ejection tray 29 or pass through the downward conveyance section 23 to be folded by the folding processing section 24 and are ejected to the elevating ejection tray 29.

The additional sheet feed section 27 accommodates the additional sheets F such as sheets for insertion or sheets for cover sheets. The additional sheets F are added to the recording sheets conveyed from the image forming apparatus A. Then the sheets are ejected to the elevating ejection tray 29 through the conveyance section.

The sheets S are ejected to the fixed ejection tray 28 in the image formation mode for forming an image on a small number of sheets and in the mode wherein processing of folding or shifting is not performed.

The sheets S and additional sheets F are ejected to the elevating ejection tray 29, in the image formation mode for forming an image on a great number of sheets, in the fold processing mode or in the shift ejection mode.

It is well known in the art that the folding processing section 24 has a function of performing various forms of fold processing such as folding into two and various types of folding-in-three. The sheets S and additional sheets F having been subjected to fold processing are conveyed to the upstream side, and are then ejected to the elevating ejection tray 29 by the sheet ejection roller 30 provided on the horizontal conveyance section 22.

The sheet ejection device 100 including the elevating ejection tray 29 has a shift ejection function.

The following describes the sheet ejection device 100 having a shift ejection function:

In the following description, "sheets S" are assumed to include additional sheets F.

Figure 4:
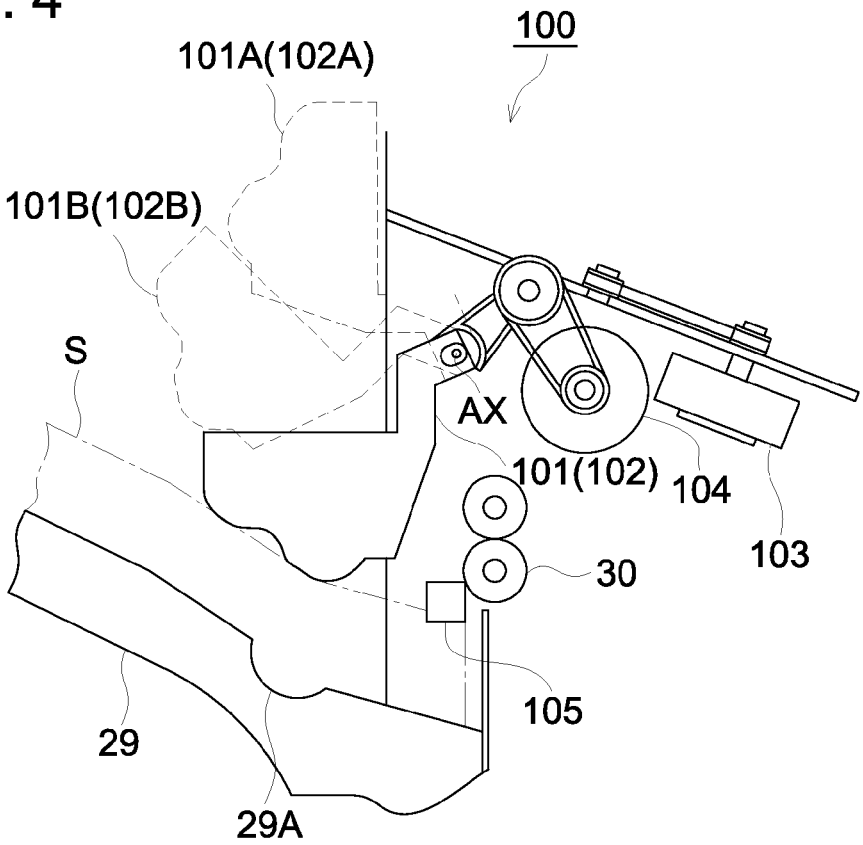
FIG. 4 is a cross sectional front view showing a sheet ejection device 100.

FIG. 4 is a cross sectional front view showing a sheet ejection device 100.

The sheet ejection device 100 is designed as a sheet ejection device for the post-processing apparatus FS. However, it can also be used as a sheet ejection device of the image forming apparatus A.

As described above, the sheets S and additional sheets F are ejected to the elevating ejection tray 29 as an ejection tray. In the following description, sheets S and additional sheets F will be collectively called "sheets S".

As described above, the sheets S ejected from the sheet ejection roller 30 are discharged to the elevating ejection tray 29. The sheets S stacked on the elevating ejection tray 29 are shown in FIG. 4.

The top surface of the sheets S is detected by the sensor 105 made up of a photoelectric sensor. The elevating ejection tray 29 performs a vertical travel to ensure that the top surface of the sheets S is kept always at a predetermined height. The vertical movement of the elevating ejection tray 29 is driven by a motor (not illustrated) under the control of the control device.

The elevating ejection tray 29 is provided with a concave portion 29A located immediately below the alignment members 101 and 102.

When the sheets S are stacked on the elevating ejection tray 29, a clearance is formed between the sheets S and elevating ejection tray 29 by the concave portion 29A, as illustrated.

The sheets S can be removed from the elevating ejection tray 29 by inserting the hand of an operator into the clearance formed by the concave portion 29A when the operator takes out the sheets S.

A pair of alignment members 101 and 102 of tabular shape is arranged above the elevating ejection tray 29. These alignment members 101 and 102 serve the function of aligning the end positions in the horizontal direction (hereinafter referred to as "across the width") at right angles to the direction in which the sheets S are conveyed and ejected, and are so arranged as to be separated from each other across the width and to be opposed to each other.

The alignment members 101 and 102 are arranged rotatably around the rotary axis AX in such a way that they can be touched and detached from the elevating ejection tray 29. The alignment members 101 and 102 are set at the alignment position indicated by a solid line, the first retracted position (101A, 102A) indicated by a dotted line, and the second retracted position (101B, 102B) also indicated by a dotted line.

The alignment members 101 and 102 are driven by the motor 104, and are set at the alignment position, the first retracted position and the second retracted position.

The solid line indicates the alignment position after a great number of sheets have been ejected and stacked on the elevating ejection tray 29 and alignment members 101 and 102 have been shifted across the width of the sheets. One of the alignment members 101 and 102 in this case is mounted on the sheets S by its own weight. Another alignment member is stopped in the state of being kept in contact with the elevating ejection tray 29, or is suspended in the air, according to the thickness of the sheets stacked on the elevating ejection tray 29.

As will be described later, the alignment members 101 and 102 travel across the width of the sheets S. This traveling is driven by the motor 103. The drive force of the motor 103 is conveyed to the alignment members 101 and 102 by the transmission mechanism using a belt and pulley.

The rotating positions of the alignment members 101 and 102, particularly the alignment position and the first and second retracted positions are set according to the signal outputted from the sensor 106 (FIG. 5) consisting of a photoelectric sensor.

Figure 5:
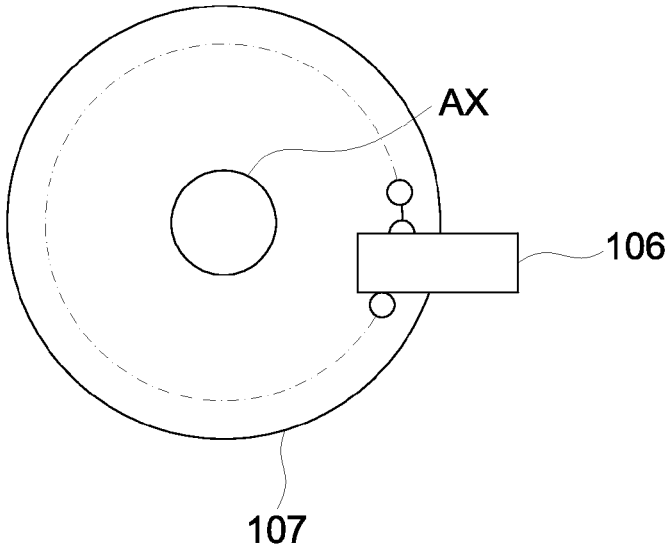
FIG. 5 is a diagram showing the mechanism for detecting the height of an alignment member.

FIG. 5 shows the mechanism constituting a detecting device for detecting the height of the alignment members 101 and 102. An encoder 107 is fixed on the rotary axis AX of the alignment members 101 and 102. The sensor 106 detects the rotary position of the encoder 107.

Figure 6:
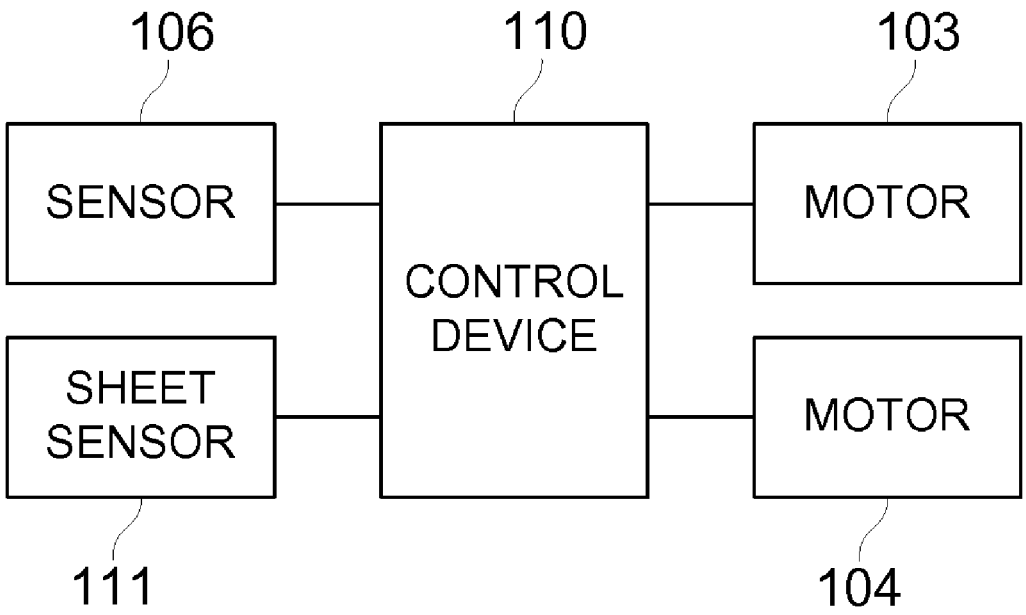
FIG. 6 is a block diagram showing the control system to provide shift control.

FIG. 6 is a block diagram showing the control system to provide shift ejection control of the sheet ejection device 100.

As described above, the reference numerals 103 and 104 of the drawing indicate a motor for driving the alignment members 101 and 102, and reference numeral 106 denotes a sensor for detecting the rotary positions of the alignment members 101 and 102.

The reference numeral 111 is a sheet sensor provided on the sheet loading section 21 of FIG. 3.

The control device 110 provides shift control according to the detection signal of the sensor 106 and sheet sensor 111.

Figure 7:
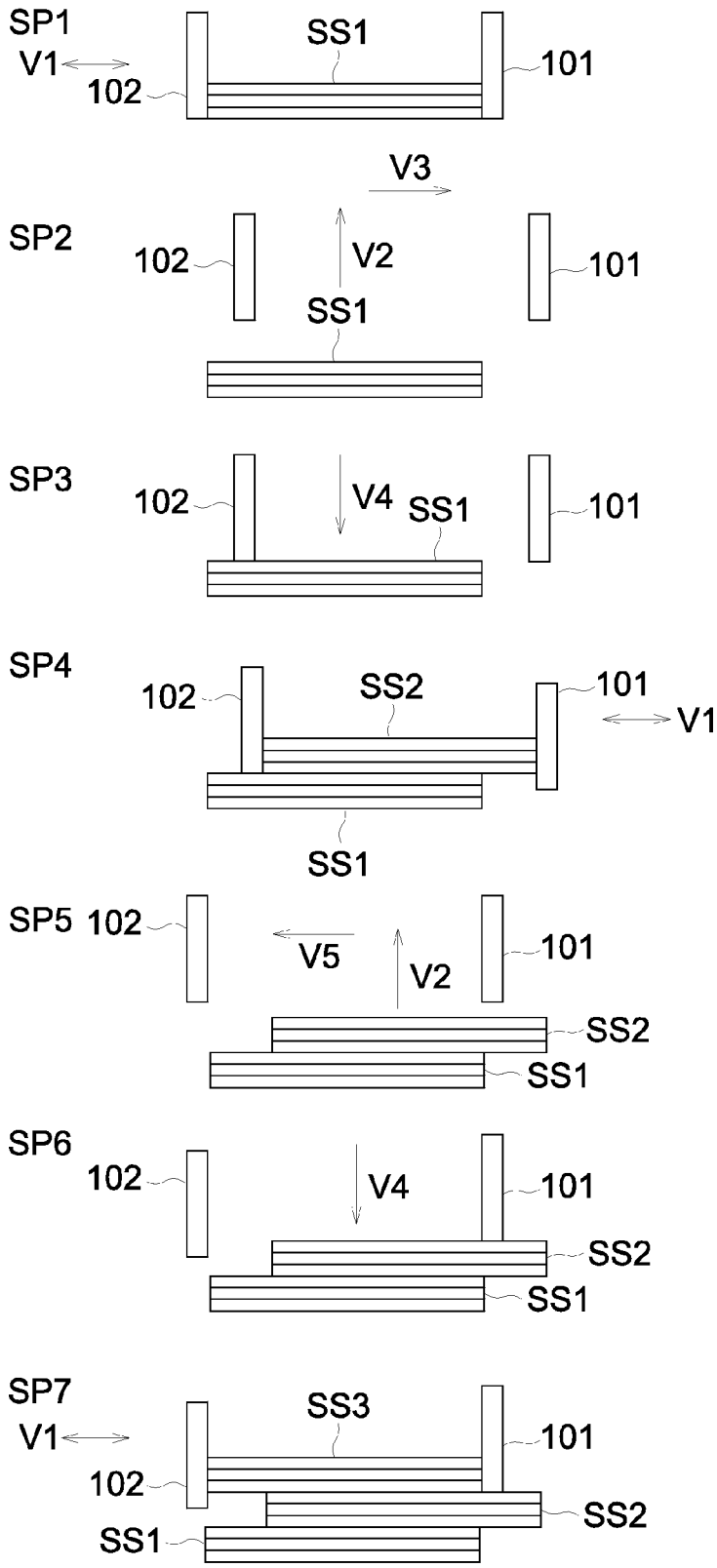
FIG. 7 is a diagram showing the step of shifting.

The following describes the shift control with reference to FIG. 7.

In FIG. 7, arrows V1, V3 and V5 indicate the direction at right angles to the direction in which sheets S are conveyed and ejected, and parallel to the sheet surface (hereinafter referred to as "across the width").

Bundles SS1 constituting sheets of preset number for one unit of the shift are stacked on the elevating ejection tray 29, as shown in Step SP1.

In SP1, the alignment members 101 and 102 are set at the alignment position as the lower position denoted by a solid line of FIG. 4. This lower position is a position in which the bottom end of the alignment members 101 and 102 is slightly lower than the support surface of the elevating ejection tray 29.

Accordingly, when the alignment members 101 and 102 are set at the lower position, they are loaded on the elevating ejection tray 29 by its own weight.

The alignment member 102 on the elevating ejection tray 29 performs a reciprocating motion across the width as shown by the arrow V1, whereby the sheets S are aligned. Sheets are aligned by the travel of the alignment member 102 every time one sheet S is ejected.

When the sheet number of bundle SS1 has reached the preset number by the signal from the sheet sensor 111, both alignment members 101 and 102 are moved in the upward direction, as indicated by arrow V2 in Step SP2. In the process of upward travel indicated by arrow V2, it is not illustrated. Both the alignment members 101 and 102 make a slight travel toward the outside from the centerline across the width to form a clearance with sheets. After that, these alignment members travel upward as indicated by arrow V2.

The traveling distance indicated by arrow V2 is such a distance that the bottom ends of the alignment members 101 and 102 are slightly away from the top surface of the sheet bundle SS1.

In Step SP2, alignment members 101 and 102 are set at the retracted height apart from the top surface of the sheet bundle SS1.

The retracted height of the alignment members 101 and 102 shown in Step SP2 is equivalent to the second retracted position of FIG. 4.

The second retracted position shown as 101B and 102B in FIG. 4 is lower than the first retracted position (indicated by 101A and 102A) where the alignment members 101 and 102 are positioned, when the sheet ejection device 100 is suspended.

Subsequent to upward traveling, the alignment members 101 and 102 shift to the right (across the width) as shown by arrow V3. The traveling distance indicated by arrow V3 corresponds to the amount of sheet shift.

As shown in Step SP3, next the alignment members 101 and 102 travel downward as indicated by arrow V4.

The alignment members 101 and 102 travel downward so that the bottom ends can be slightly lower than the top surface of the sheet bundle SS1. As a result, the alignment member 102 is placed on the sheet bundle SS1, and the bottom end of the alignment member 101 is placed slightly lower than the topmost surface of the sheet bundle SS1.

In Step SP4, the alignment member 101 makes a reciprocating motion across the width as indicated by arrow V1, whereby the sheets are aligned.

Step SP5 is in the same stage as the Step SP2. After the alignment members 101 and 102 have traveled upward as indicated by arrow V2, they perform a horizontal travel to the left as indicated by arrow V5.

The Step SP5 is followed by Step SP6 in which a step has been taken to set the alignment position after the alignment members 101 and 102 have performed a downward shift as indicated by arrow V4.

In the Step SP7 following the Step SP6, the alignment member 102 performs a reciprocating motion as indicated by arrow VI, whereby sheets S are aligned.

Sheet bundles SS1, SS2 and SS3 having been subjected to shift processing are formed in the alignment process of Steps SP1 through SP7.

Figure 8:
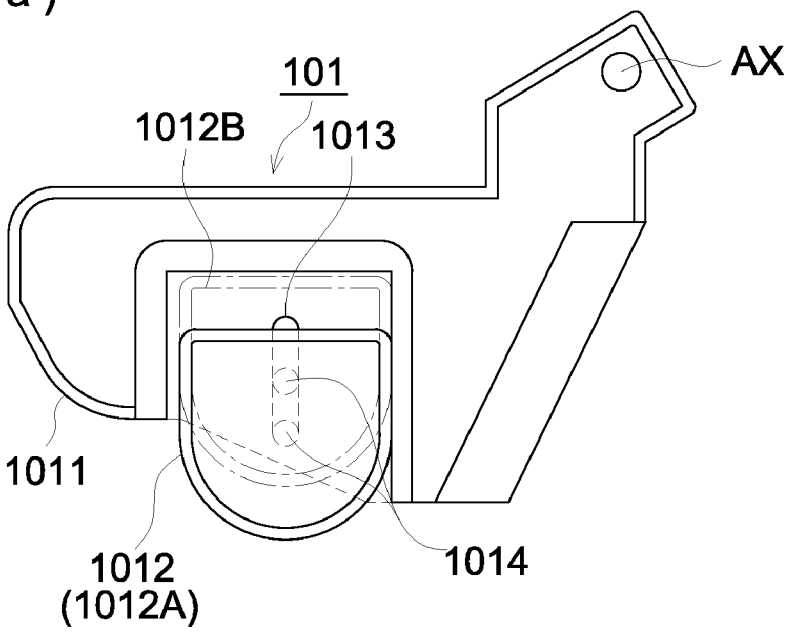
FIGS. 8(*a*) and 8(*b*) are enlarged views of the alignment member at the position indicated by a solid line of FIG. 4.
Figure 8:
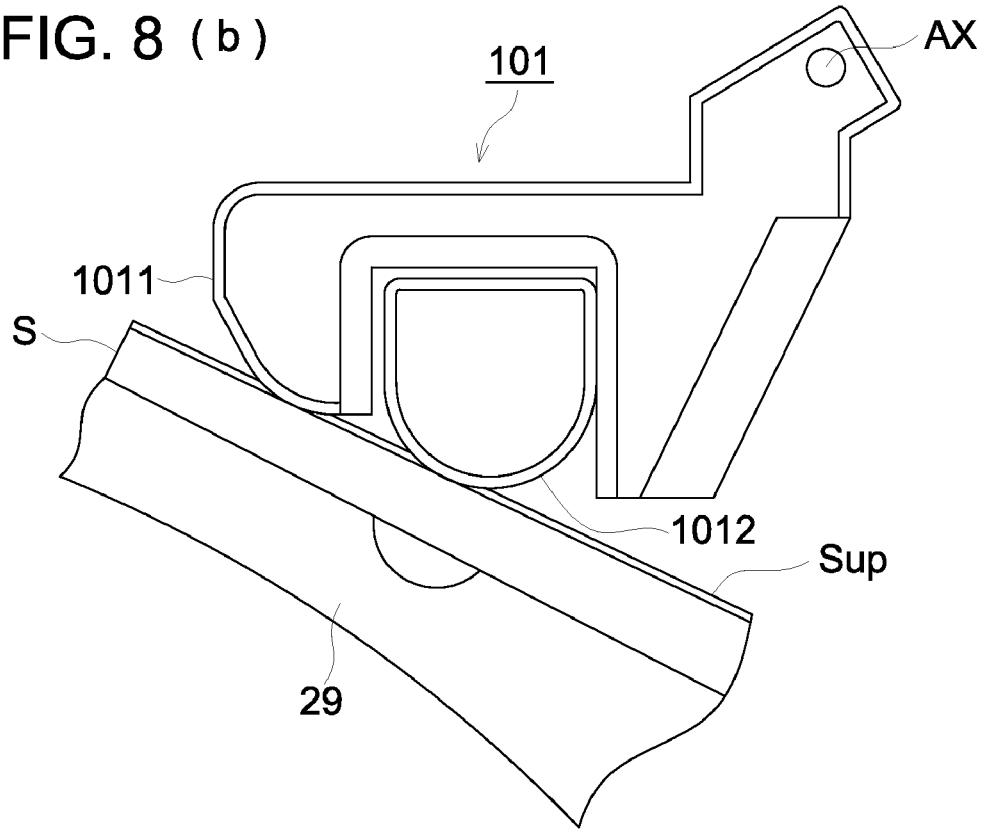

FIGS. 8(*a*) and 8(*b*) are front views of the alignment member 101, and are enlarged views of the alignment member 101 located at the position indicated by a solid line of FIG. 4.

The alignment member 101 includes a first alignment member 1011 supported rotatably around the axis AX, and a second alignment member 1012 supported by the first alignment member.

As shown in the drawing, the second alignment member 1012 is arranged inside the recess portion of the first alignment member 1011, and is slidable with reference to the first alignment member 1011 between the position indicated by 1012A and the position indicated by 1012B.

The first alignment member 1011 is provided with a slit 1013 which is engaged with the pin 1014 arranged on the second alignment member 1012.

Guided by the slit 1013 and pin 1014, the second alignment member 1012 travels in the vertical direction with reference to the first alignment member 1011.

FIG. 8(*a*) shows the state when the alignment member 101 is not in contact with the elevating ejection tray 29 or the top surface of the sheets S loaded on the elevating ejection tray 29. In this case, the second alignment member 1012 is lowered to the bottom position by its own weight.

FIG. 8(*b*) shows the state when the alignment member 101 is loaded on the sheets S which are stacked on the elevating ejection tray 29.

Figure 9:
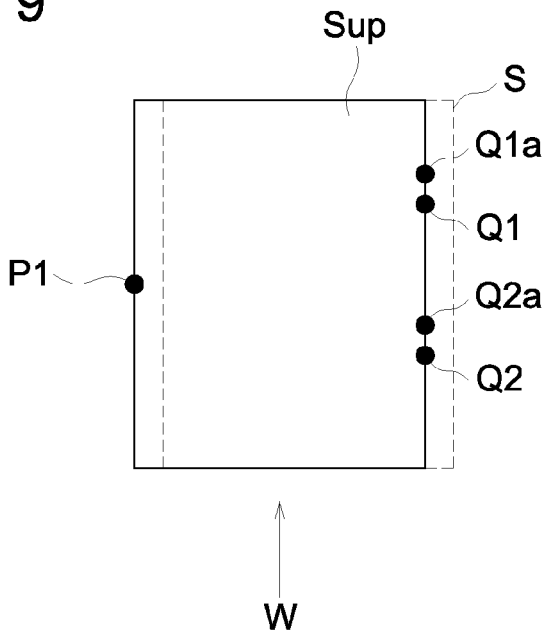
FIG. 9 is a diagram representing the alignment operation in an embodiment of the present invention.

As shown in FIG. 8(*b*), when the alignment member 101 is loaded on the stop surface of the sheets S, the first alignment member 1011 and the second alignment member 1012 are always kept in contact with the sheets S on the elevating ejection tray 29, independently of whether the sheets are curled or not. As shown in FIG. 9, the alignment member 101 acts on the sheets Sup ejected and loaded on the sheets S in such a way that the bottom end of the first alignment member 1011 regulates the edge of the sheets Sup at point Q1, and the bottom end of the second alignment member 1012 regulates the edge of the sheets Sup at point Q2.

Similarly to the alignment member 101, the alignment member 102 also includes the first alignment member and second alignment member of FIGS. 8(*a*) and 8(*b*).

In Step SP4 of FIG. 7, the alignment member 101 is in the state of FIG. 8(*a*), and the alignment member 102 is in the state of FIG. 8(*b*).

In Step SP4 of FIG. 7, the alignment member 101 performs a reciprocating motion and aligns the sheets S. The alignment member 102 regulates the position of the sheets S.

When the alignment member 102 regulates the position, position regulation is performed at two points in the sheet ejection direction W. To be more specific, the bottom end of the first alignment member regulates the position of the sheets Sup at point Q1 of FIG. 9, and the bottom end of the second alignment member regulates the position of the sheets Sup at point Q2 of FIG. 9.

The alignment member 101 pushes the sheets S at center point of action P1, whereby the sheets S are aligned. The center point of action P1 is the center position of the pushing force of the alignment member 101.

Figure 1:
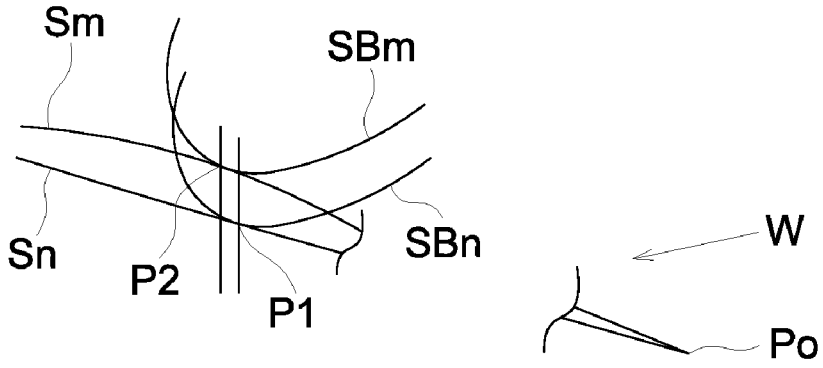
FIG. 1 is a diagram for explanation of the misalignment of sheets in the conventional shift alignment process.

Even when the sheets S on which the alignment member 102 is loaded are curled and the positions of sheets Sup regulated by the alignment member 102 have shifted to Q1*a* and Q2*a*, the positions to be regulated by the alignment member 102 are two points in the sheet ejection direction W. This ensures that the sheets are not rotated under the force of the alignment member 101, as shown in FIG. 1.

Figure 2:
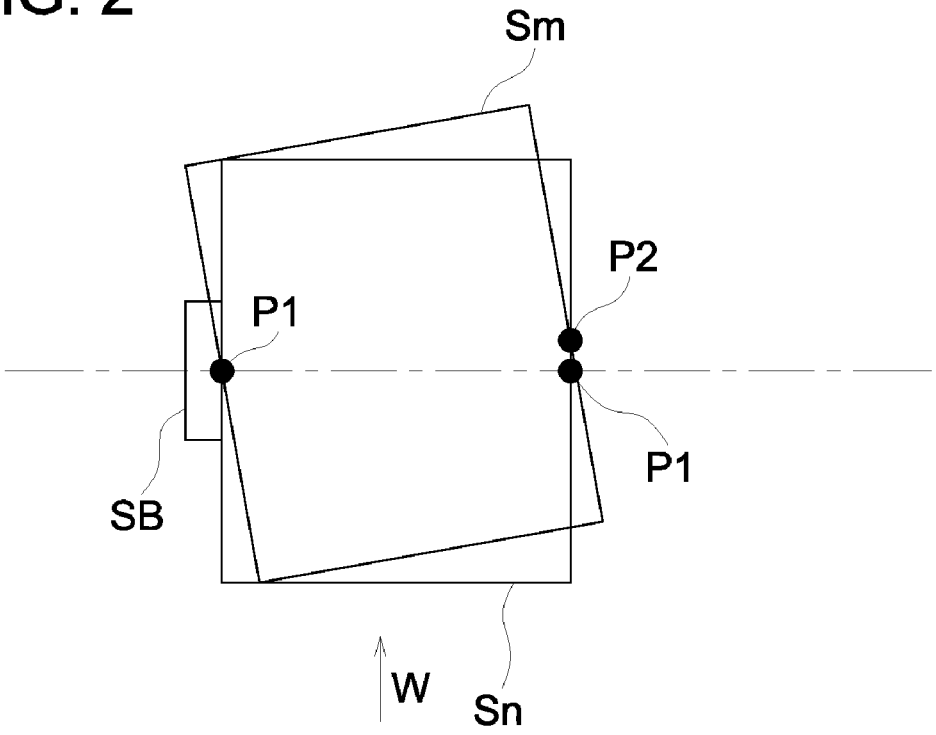
FIG. 2 is a diagram for explanation of the misalignment of sheets in the conventional shift alignment process.

As shown in FIG. 2, when one position is regulated, the precision of aligning several leading sheets of each sheet bundle may be reduced in some cases in the alignment process for the each sheet bundle. As will be apparent from FIG. 9, there are two points to be regulated, and therefore, high-precision alignment of sheets is ensured from the first sheet of each sheet bundle.

As shown in FIGS. 8(*a*) and 8(*b*), the first alignment member 1011 and second alignment member 1012 are designed in such a way that their leading edges (the bottom ends) are formed in a gentle circular arc. Thus, when a sheet is loaded on the sheets S stacked on the elevating ejection tray 29 and is aligned, the width of the regulated position with respect to the sheet is the minimum for the first sheet. The width of the regulated position is increased for the sheet that comes later.

As has been described, alignment precision for the first sheet is enhanced. The alignment precision for the succeeding sheets is further improved.

Thus, even when sheets are curled, highprecision regulation of the sheet position is ensured, and the position alignment across the width is achieved, as described above.

In Step SP7 of FIG. 7, the position is regulated by the alignment member 101, and sheets are aligned by the alignment member 102. In this case, the aforementioned highprecision alignment is performed on condition that the positional relationship between the positions Q1 (Q1*a*) and Q2 (Q2*a*) in the sheet ejection direction W, and point P1 is reversed in FIG. 9.

Figure 10:
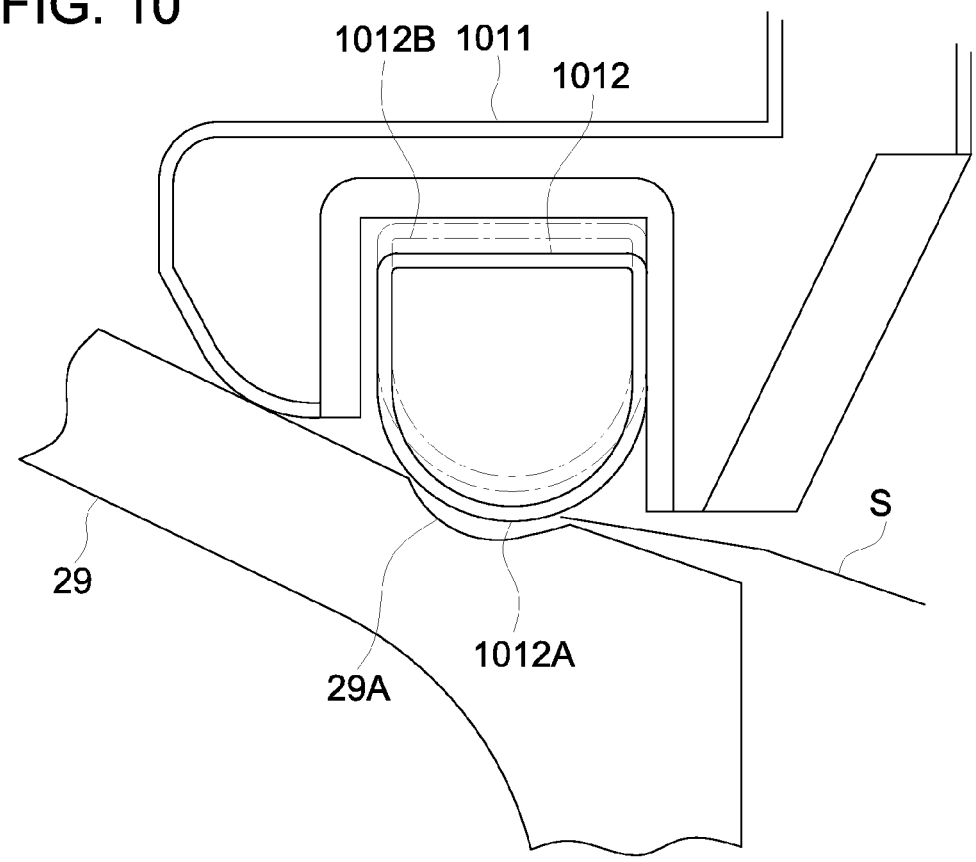
FIG. 10 is a diagram showing the sheet ejection device in the initial stage of sheet stacking operation.

FIG. 10 shows the initial stage of stacking the sheets S when there is no sheet S on the elevating ejection tray 29.

As illustrated, the second alignment member 1012 is arranged immediately above the concave portion 29A provided on the elevating ejection tray 29. When the bottom end of the first alignment member 1011 is kept in contact with the elevating ejection tray 29, the bottom end 1012A of the second alignment member 1012 is lowered into the concave portion 29A.

If the sheets S are ejected in this state, the edges of the sheets S is positioned correctly at two points by the first alignment member 1011 in contact with the elevating ejection tray 29 and the second alignment member 1012 having lowered into the concave portion 29A.

Thus, sheets S are positioned and aligned correctly from the first sheet.

Figure 11:
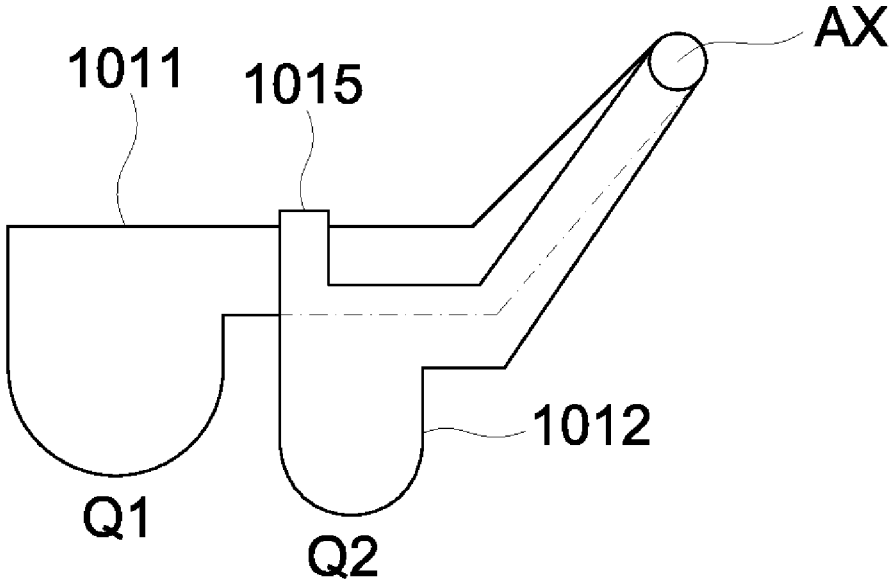
FIG. 11 is a diagram representing another embodiment of the present invention.

FIG. 11 shows the major portions of another embodiment of the present invention.

The first alignment member 1011 is supported rotatably around the axis AX.

The second alignment member 1012 is also supported rotatably around the axis AX. The first alignment member 1011 and second alignment member 1012 are rotatable independently of each other. The second alignment member 1012 is placed on the first alignment member 1011 by the hook 1015 arranged on the top end of the second alignment member 1012.

Thus, when the first alignment member 1011 goes up to the retracted position, the second alignment member 1012 also goes up in conformity to the movement of the first alignment member 1011.

The first alignment member 1011 placed on the top surface of the sheets S stacked on the elevating ejection tray 29 is brought in contact with the side edge of the sheet to be aligned (sheet indicated by "Sup" in FIG. 9), at point Q1. The second alignment member 1012 comes in contact with the side edge of the sheet to be aligned (sheet indicated by "Sup" in FIG. 9), at point Q2.

High-precision alignment of sheets S is ensured by the aforementioned structure.

In the aforementioned embodiment, the alignment member contacts the top surface of the sheets stacked on the ejection tray at two points, and the positions of the sheets S ejected and stacked thereafter are aligned. However, the number of the points of contact with the top surface of the sheets is not restricted to two points. The number of contact points can be three or more. Such a structure is also included in the present invention. To put it more specifically, in addition to the first alignment member 1011 and second alignment member 1012, a third and fourth alignment members can be provided.

What is claimed is:

1. A sheet ejection device comprising:

a sheet ejection tray which is adapted to be loaded with a sheet to be ejected in an ejection direction;

a pair of alignment members each of which is configured to align an end position of the ejected sheet in a direction perpendicular to the ejection direction; and a drive device which: (i) sets one of the pair of alignment members to a position so that said one of the pair of alignment members comes in contact with an upper surface of a first sheet loaded on the sheet ejection tray at a plurality of points which are located in a single straight line parallel to the ejection direction, and (ii) drives the other of the pair of alignment members so that the other of the pair of alignment members pushes, in the direction perpendicular to the ejection direction, an end of a second sheet ejected on the first sheet while said one of the pair of alignment members is in contact with the upper surface of the first sheet at the plurality of points.

2. The sheet ejection device of claim 1, wherein each of the pair of alignment members comprises:

a first alignment member which is adapted to come in contact with an upper surface of a given sheet at one point among a plurality of points in the ejection direction; and a second alignment member which is adapted to come in contact with the upper surface of the given sheet at another point among the plurality of points in the ejection direction.

3. The sheet ejection device of claim 2, further comprising:

a first position restricting guide and a first sliding surface which are integrally constructed with each first alignment member; and a second position restricting guide and a second sliding surface which are integrally constructed with each second alignment member;

wherein in a given one of the pair of alignment members, the second alignment member is supported by the first alignment member by restricting a relative position of the first and second alignment members using the first and second position restricting guides, so that the second alignment member can slide with respect to the first alignment member by allowing the first and second sliding surfaces to slide with respect to each other.

4. The sheet ejection device of claim 2, wherein each of the first alignment member and the second alignment member is rotatably supported independently of each other at an upstream portion with respect to the plurality of points in the ejection direction.

5. The sheet ejection device of claim 1, wherein each the pair of alignment members is supported rotatably at an upstream portion with respect to the plurality of points in the ejection direction.

6. The sheet ejection device of claim 1, wherein the sheet ejection tray has a recess formed at a position corresponding to at least one of the plurality of points.

7. The sheet ejection device of claim 6, wherein each of the pair of alignment members is adapted to enter the recess and come in contact with a portion except the recess on the sheet ejection tray.

8. An image forming apparatus which comprises the sheet ejection device of claim 1.

9. A post-processing apparatus which comprises the sheet ejection device of claim 1.

10. A sheet ejection device comprising:

a sheet ejection tray which is adapted to be loaded with a sheet to be ejected in an ejection direction;

a pair of alignment members each of which is configured to align an end position of the ejected sheet in a direction perpendicular to the ejection direction; and a drive device which: (i) sets one of the pair of alignment members to a position so that said one of the pair of alignment members comes in contact with an upper surface of a first sheet loaded on the sheet ejection tray at a plurality of points in the ejection direction, and (ii) drives the other of the pair of alignment members so that the other of the pair of alignment members pushes an end of a second sheet ejected on the first sheet while said one of the pair of alignment members is in contact with the upper surface of the first sheet at the plurality of points, wherein each of the pair of alignment members is adapted to: (i) come in contact at a plurality of points with a sheet which is loaded directly on the sheet ejection tray, and (ii) come in contact at the plurality of points with a sheet which is loaded on another sheet on the sheet ejection tray.

11. The sheet ejection device of claim 10, wherein each of the pair of alignment members is adapted to: (i) come in contact at the plurality of points with said sheet which is loaded directly on the sheet ejection tray, and (ii) come in contact at the plurality of points with a sheet which is loaded on any number less than a predetermined number of sheets on the sheet ejection tray.

12. The sheet ejection device of claim 10, wherein each of the pair of alignment members comprises:

a first alignment member which is adapted to come in contact with an upper surface of a given sheet at one point among a plurality of points in the ejection direction; and a second alignment member which is adapted to come in contact with the upper surface of the given sheet at another point among the plurality of points in the ejection direction.

13. The sheet ejection device of claim 12, further comprising:

a first position restricting guide and a first sliding surface which are integrally constructed with each first alignment member; and a second position restricting guide and a second sliding surface which are integrally constructed with each second alignment member, wherein in a given one of the pair of alignment members, the second alignment member is supported by the first alignment member by restricting a relative position of the first and second alignment members using the first and second position restricting guides, so that the second alignment member can slide with respect to the first alignment member by allowing the first and second sliding surfaces to slide with respect to each other.

14. The sheet ejection device of claim 12, wherein each of the first alignment member and the second alignment member is rotatably supported independently of each other at an upstream portion with respect to the plurality of points in the ejection direction.

15. The sheet ejection device of claim 10, wherein each the pair of alignment members is supported rotatably at an upstream portion with respect to the plurality of points in the ejection direction.

16. The sheet ejection device of claim 10, wherein the sheet ejection tray has a recess formed at a position corresponding to at least one of the plurality of points.

17. The sheet ejection device of claim 16, wherein each of the pair of alignment members is adapted to enter the recess and come in contact with a portion except the recess on the sheet ejection tray.

18. An image forming apparatus which comprises the sheet ejection device of claim 10.

19. A post-processing apparatus which comprises the sheet ejection device of claim 10.

* * * * *